United States Patent [19]

Lin

[11] Patent Number: 4,739,638

[45] Date of Patent: Apr. 26, 1988

[54] BI-DIRECTIONAL DEADLOCK

[76] Inventor: George Lin, P.O. Box 10160, Taipei, Taiwan

[21] Appl. No.: 10,963

[22] Filed: Feb. 3, 1987

[51] Int. Cl.[4] ..... E05B 65/06

[52] U.S. Cl. ..... 70/129; 70/134; 70/143; 70/221; 70/386; 292/74; 292/335

[58] Field of Search ..... 70/218, 221, 143, 386, 70/134, 129, 222, 223; 292/74, 169.13, 335

[56] References Cited

U.S. PATENT DOCUMENTS

| | | | |
|---|---|---|---|
| 2,111,511 | 3/1938 | Lowe | 70/221 |
| 2,446,753 | 8/1948 | Floraday | 70/221 |
| 2,676,829 | 4/1954 | Sterner | 292/335 |
| 2,745,120 | 7/1956 | Young | 292/74 |
| 3,495,861 | 2/1970 | Snow | 292/74 |
| 3,621,686 | 11/1971 | Klein | 292/335 |

*Primary Examiner*—Robert L. Wolfe

[57] ABSTRACT

A deadlock includes a casing, a front knob and a rear knob respectively rotatably formed on the front and rear walls of the casing, and a slidable latch reciprocatively mounted in the casing as driven by either the front or rear knob, wherein the latch is formed a triangular locking tongue having two inclined surfaces so that the latch can be conveniently used in a bi-directional door when opening the door either outwards or inwards.

2 Claims, 4 Drawing Sheets

BI-DIRECTIONAL DEADLOCK

BACKGROUND OF THE INVENTION

An Australian Patent Application No. 70208/81 filed by Whitco Pty. disclosed a deadlock wherein the main bolt enters the striker plate to a greater depth when the lock is in the locked position and which however has the following defects:

1. The locking tongue (21) having a single angled face (22, not double angled face) can only be provided for a single-direction door opening or closing, to thereby be inconvenient for a door system requiring a bi-directional in-and-out opening or closing operation.

2. Since the tongue (21) has a single angled face (22) and the striker plate (23) should be carefully oriented in a single direction as mounted on a door frame, adapted to receive the inclined surface of the tongue when closing a door, it is therefore inconvenient for installing such a conventional deadlock on a door and a door frame.

The present inventor has found the defects of a conventional deadlock and invented the present bi-directional deadlock.

SUMMARY OF THE INVENTION

The object of the present invention is to provide a deadlock including a casing, a pair of knobs respectively rotatably mounted on the front side and the rear side of the casing, and a latch actuator slidably operating a slidable latch when rotating either front or rear knob to extend such a latch for locking a door provided with the deadlock or to retract such a latch into the casing for opening the door, wherein the latch is formed with a pair of inclined surfaces on the latch head, both inclined surfaces projecting outwards to form a triangular tongue to be adapted for a door system which can be bi-directionally opened or closed either outwards or inwards for convenient installation and uses.

DETAILED DESCRIPTION

Figure 1:
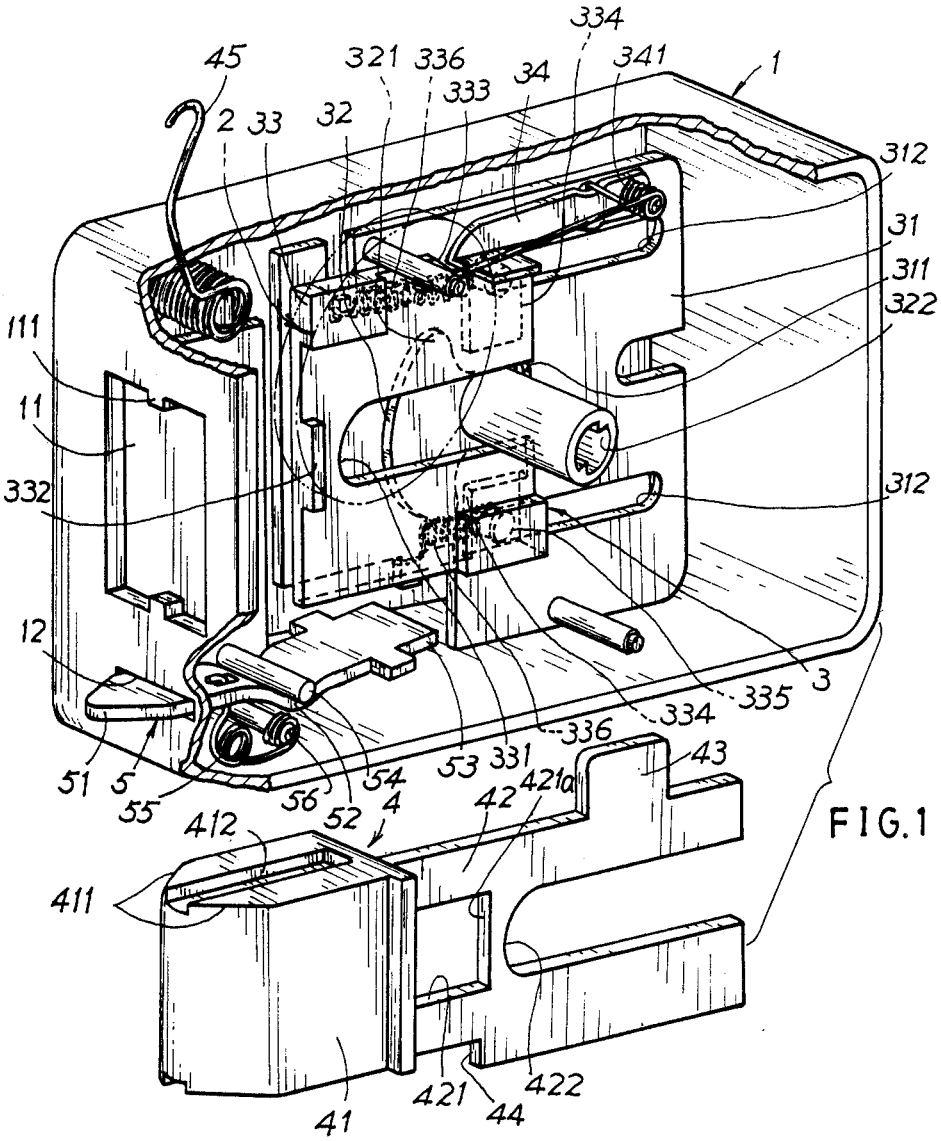
FIG. 1 is a perspective drawing of the present invention.

As shown in the figures, the present invention comprises a casing 1, a front knob 2 rotatably mounted on the front side of the casing 1, a latch actuator 3 formed in the casing 1, a slidable latch 4 slidably mounted in the casing 1 as controlled by the actuator 3, a latch releaser 5 operatively releasing the latch for locking a door, and a rear knob 6 provided on the rear side of the casing.

The casing 1 is formed with a latch hole 11 having a pair of extensions 111 on the upper and lower edges of hole 11 on the left-side wall of casing 1 and formed with a latch releaser hole 12 under the hole 11.

Figure 3A:
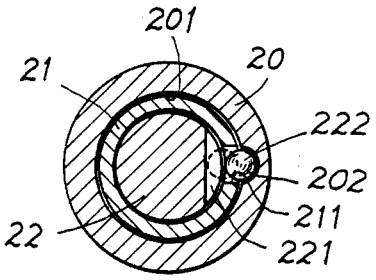
FIG. 3*a* is a sectional drawing of a front knob of the present invention when viewed from II—II direction of FIG. 3.
Figure 2:
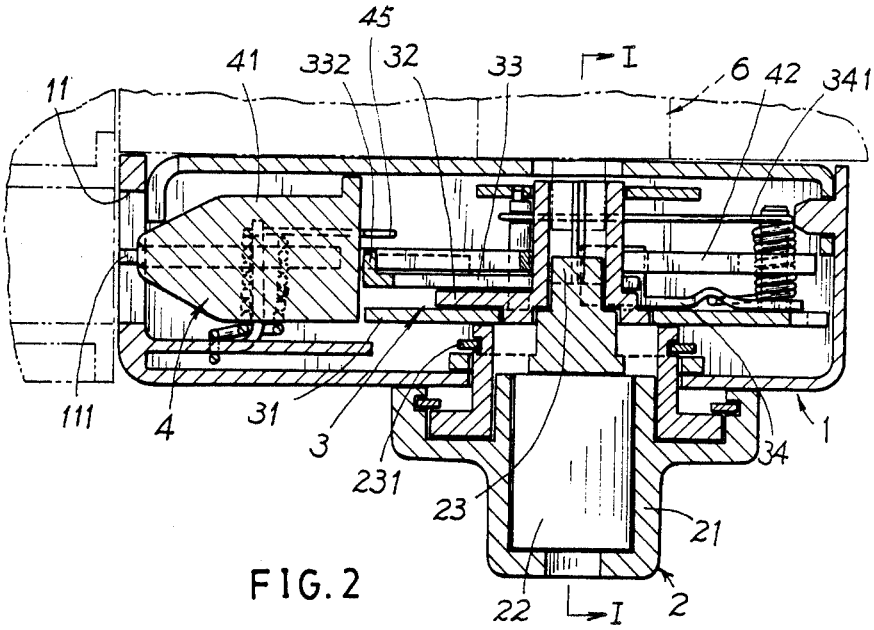
FIG. 2 is a top-view sectional drawing of the present invention.
Figure 3:
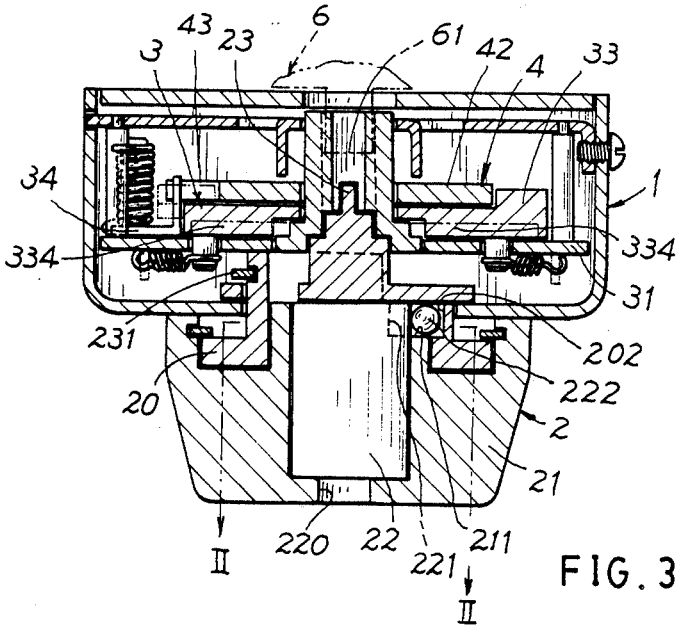
FIG. 3 is a sectional drawing of the present invention when viewed from I—I direction of FIG. 2.

The front knob 2 includes: a sleeve portion 20 rotatably mounted on the front wall of casing 1 having an inner cylindrical hole 201 formed with a recess portion 202 adapted for engaging a ball 222 therein, a rotating knob 21 having a hole 211 operatively communicated with the recess portion 202 of sleeve portion 20 and commonly rotating with the sleeve portion 20 when the ball 222 is engaged in the hole 202 and recess portion 202 to couple the sleeve portion 20 and the rotating knob 21, a lock cylinder 22 having a key hole 220 rotatably formed in the knob 21 and having a recess portion 221 adapted to engage the ball between the recess portion 221 and the hole 211 for coupling the cylinder 22 and the knob 21 when the lock cylinder 22 is rotatably locked by a key upon the engagement of the ball 222 between the recess portion 221 and the hole 221 as shown in FIG. 3*a*, and a front driver-head 23 coupled with the sleeve portion 20 by a retainer 231 protruding rearwards from the front wall of casing 1.

The latch actuator 3 includes: a guiding base 1 secured on the front wall of casing 1 having a central hole 311 for rotatably mounting a sector cam 32 and having two parallel longitudinal grooves 312 horizontally formed on the base 1; a sector cam 32 shaped as a semicircle and having two pusher heads 321 respectively formed on the upper and lower ends of the cam and having a cylindrical driver socket 322 adapted for engagement with the front driver-head 23 from its front end and with a rear driver-head 61 of a rear knob 6 as rotatably secured on the rear wall (mounted on door D) of a casing 1 from its rear end; a reciprocative controller 33 overlying the sector cam 32 and generally formed as a rectangular plate having a longitudinal slot 331 for its reciprocative movement without being obstructed by the socket 322, a pulling lug 332 extending on the left edge of the controller 33, a slope edge 333 inclined rightwards and formed on the upper right corner of the controller 33, a pair of bottom extensions 334 protruding towards the front knob 2 from the controller plate and positioned at the two right corners adapted to be pushed by the two pusher heads 321 of cam 32 which can be rotated either clockwise or counter-clockwise, and a pair of rods 335 respectively formed on the two extensions 334 each slidably guided in each longitudinal groove 312 of the base 31 as restored by either of the two springs 336 secured on the base 31; and a latch locker 34 pivotedly formed on the upper right corner in the casing 1 and restored by a restoring spring 341 to normally act the locker 34 downwards or counter-clockwise.

The slidable latch 4 includes: a locking tongue 41 having two inclined surfaces 411 forming a triangular head with triangle cross section and having two grooves 412 respectively formed on the upper and lower faces of the tongue and slidably engaged with the two extensions 111 formed on the latch hole 11 of casing 1 and operatively protruding leftwards to be locked into a socket 46 fixed on a door frame F, a carrier plate 42 pertinent to the tongue 41 having a central window 421 defined between tongue 41 and a right window edge 421*a* adapted to be pulled by the pulling lug 332 of controller 33, a right slot 422 adapted for free movement of the latch 4 without being obstructed by socket 322, an upper lug 43 extending on the upper right corner of the carrier plate 42 adapted for locking of locker 34 either on the left side or the right side of the lug 43, a detent notch 44 formed on the lower portion of the plate 42 operatively detented by the latch releaser 5, and a restoring spring 45 normally restoring the tongue 41 leftwards by resiliently pressing the right edge 413 of tongue 41.

The latch releaser 5 formed as a generally horizontal plate includes a striker plate 51 formed as a triangle shape horizontally telescopically moving through the hole 12 of casing 1, a middle arched portion 52 arcuated downwards and normally disposed around an upper stick 54 formed on casing 1, a stopping end 53 formed on the right end of the releaser 5, a storing spring 55 normally retaining the striker plate 51 leftwards and secured to a lower stick 56 positioned under the stick 54.

Figure 4:
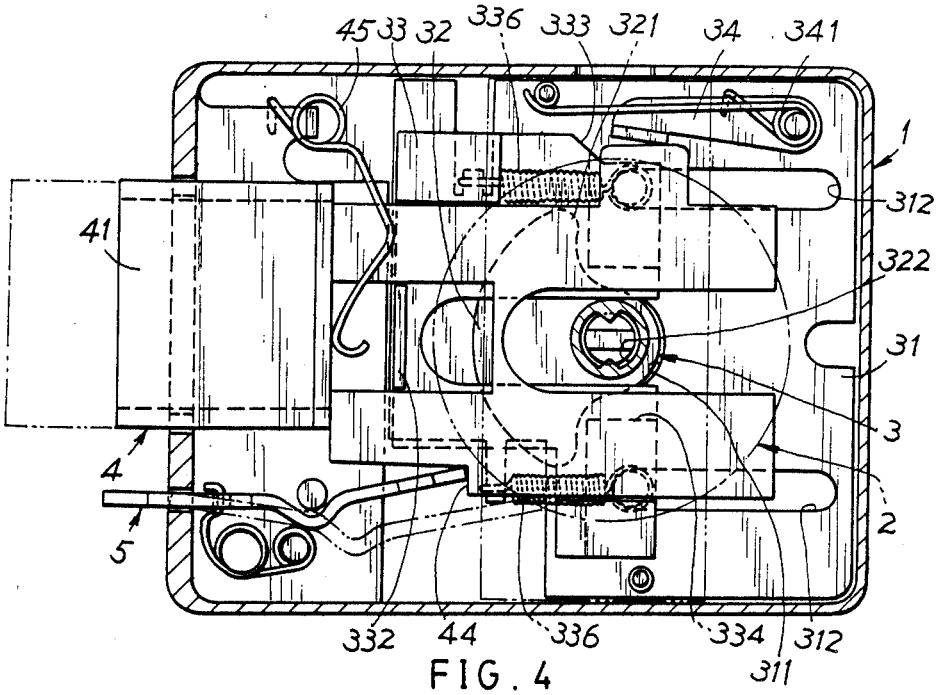
FIG. 4 is a rear-view illustration of the present invention when primarily extending a latch.
Figure 5:
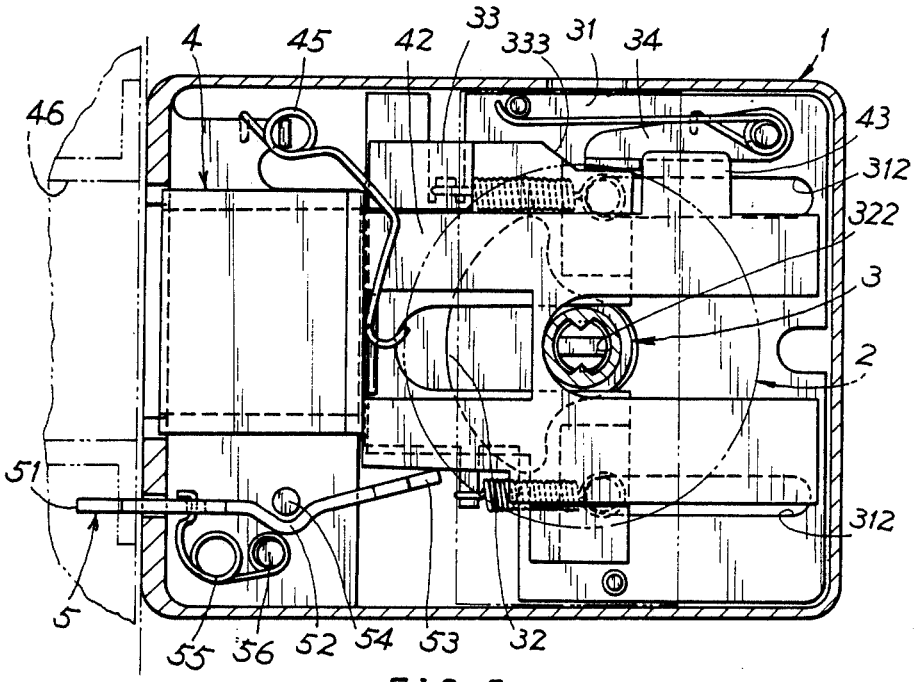
FIG. 5 is an installation of the present invention when retracting the latch into a casing.

When the tongue 41 of latch 4 is partially protruded leftwards as shown in FIG. 4, the latch is detented by the latch releaser 5 whereas the upper lug 43 is no longer obstructed by the latch locker 34. If for temporarily opening a door D provided with the present deadlock, the tongue 41 can be depressed rightwards to retract into casing 1 as shown in FIG. 5 and the upper lug 43 of latch 4 is locked by the latch locker 34 so that the door can be free opened without being locked.

Figure 6:
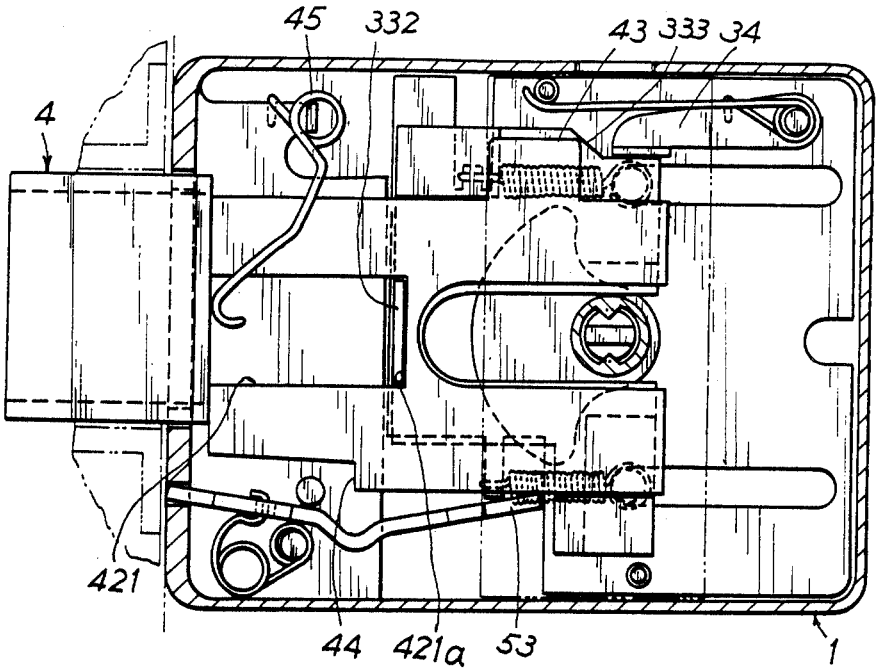
FIG. 6 is an illustration of the present invention when secondarily extending the latch for locking purpose.
Figure 7:
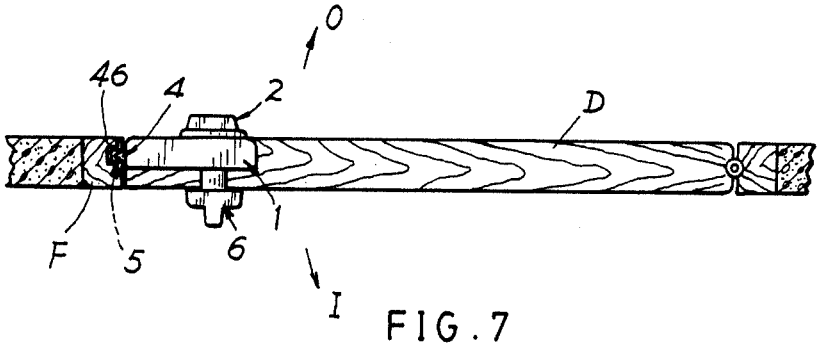
FIG. 7 is a top-view illustration showing the bi-directional operation of a door provided with the present invention.

When closing the door from the position as shown in FIGS. 4 and 7, the striker plate 51 is depressed as striking against the door frame F and the arched portion 52 is biased by the upper stick 54 to move the stopping end 53 downwards as shown in dotted line of FIG. 4 to release the detention of the end 53 against the notch 44 so that the tongue 41 will be restored by spring 45 to protrude leftwards for deeper locking of the latch 4 as shown in full line of FIG. 6 and dotted line of FIG. 4. At this moment, if a key is inserted into key hole 220 of lock cylinder 22 to lock the cylinder 22 to slip the ball 222 into hole 211 and recess portion 221 as shown in FIG. 3*a* to uncouple the knob 21 and the sleeve poriton 20 to thereby free rotate the knob 21, unable to rotate the driver 23, the cam 32, and the latch 4 for security locking purpose.

When opening the lock of the present invention, the cylinder 22 is unlocked and the knob 21 is rotated to revolve the cam 32 to retract the controller 33, whereby the slope edge 333 will be moved rightwards to push the locker 34 upwards without further detenting the lug 43 of latch 4 and the latch 4 will be retracted rightwards as the full line shown in FIG. 4 as the pulling lug 332 is also moved rightwards to pull the edge 421*a* and latch 4 rightwards until the stopping end 53 of releaser 5 re-engage with the notch 44 of latch 4 as shown in FIG. 4 whereby the door can be opened since the triangle striker plate 51 and the triangular-head tongue 41 can be slippingly retracted as impacting against the door frame F.

The present invention can be conveniently used in a bi-directional door which can be opened either outwards (O) or inwards (I) as shown in FIG. 7 since the double inclined surfaces exist on either such tongue 41 or striker plate 51.

I claim:

1. A deadlock comprising:

a casing having a latch hole and a latch releaser hole formed on a left side of the casing;

a front knob including a sleeve portion rotatably mounted on a front wall of said casing, a front driver-head coupled with said sleeve portion and protruding rearwards from the front wall of said casing, a rotating knob operatively coupling said sleeve portion when unlocking a lock cylinder rotatably formed in said knob, said rotating knob being free rotated to uncouple said sleeve poriton when locking said lock cylinder;

a latch actuator secured on the front wall of said casing including a guiding base having two parallel longitudinal grooves formed on said base, a sector cam as semi-circle shape having two pusher heads respectively formed on its upper and lower ends and a cylindrical socket engaged with said front driver-head, a reciprocative controller having a pulling lug formed on its left edge, a slope edge formed on its upper right corner and inclined rightwards, two bottom extensions protruding towards the front knob adapted to be pushed by said pusher heads of said cam, and two rods respectively formed on said two bottom extensions slidably guided in said two longitudinal grooves of said base and normally restored leftwards by two restoring springs secured to said base, and a latch locker normally acting downwards by a spring;

a slidable latch including a locking tongue slidably moving through said latch hole and operatively protruding leftwards to be locked into a socket formed on a door frame, a carrier plate pertinent to said tongue and formed a central window defined between said tongue and its rear edge adapted to be pulled by said pulling lug of said controller, an upper lug formed on the upper right corner of said carrier plate adapted to be locked by said latch locker, a detent notch formed on a lower portion of said carrier plate, and a restoring spring normally protruding said tongue leftwards;

a latch releaser having a triangle striker plate telescopically moving through said releaser hole, a middle arched portion formed on its central portion disposed around an upper stick formed on said casing, a stopping end formed on its right end to operatively detent said recess portion of said latch, and a restoring spring normally retaining said striker plate leftwards; and a rear knob rotatably mounted on a rear wall of said casing fixed on a door and having a rear driver-head engged with said socket of said cam; whereby upon the rotation clockwise or counter-clockwise of either said knob, said cam will be driven to push said reciprocative controller rightwards to retract said latch into said casing for opening the door; whereby upon the locking of said lock cylinder to free rotate said front knob without driving said cam and without retracting said latch to allow said locking tongue deeply locked in the socket of the door frame when said triangle striker plate being retracted by the door; and whereby upon the depression of said tongue, as partially protruding into said casing to allow said latch locker detenting said upper lug for retracting said tongue completely into said casing for the free opening of the door.

2. A deadlock according to claim 1, wherein said rotating knob of said front knob is operatively coupled with said sleeve portion by a ball for normal driving of said latch, said ball slippingly coupling said lock cylinder and said rotating knob when inserting a key into a key hole formed on said lock cylinder to lock said lock cylinder, unable to drive said cam and said latch.

* * * * *